United States Patent [19]

Kawamoto et al.

[11] Patent Number: 4,528,884

[45] Date of Patent: Jul. 16, 1985

[54] WAVE READING APPARATUS

[75] Inventors: Kinji Kawamoto, Yahata; Kazuhiro Murase, Hirakata, both of Japan

[73] Assignee: Matsushita Electric Industrial Co., Ltd., Osaka, Japan

[21] Appl. No.: 515,255

[22] Filed: Jul. 19, 1983

[30] Foreign Application Priority Data

Jul. 19, 1982 [JP] Japan ..... 57-126413
Dec. 15, 1982 [JP] Japan ..... 57-220945

[51] Int. Cl.[3] ..... G10H 1/057; G10H 7/00

[52] U.S. Cl. ..... 84/1.01; 84/1.22; 84/1.26

[58] Field of Search ..... 84/1.01, 1.11–1.13, 84/1.19–1.24

[56] References Cited

U.S. PATENT DOCUMENTS

| | | | |
|---|---|---|---|
| 3,755,608 | 8/1973 | Deutsch | 84/1.01 |
| 3,902,397 | 9/1975 | Morez et al. | 84/1.01 X |
| 4,085,644 | 4/1978 | Deutsch | 84/1.01 |
| 4,119,005 | 10/1978 | Kondo et al. | 84/1.01 |
| 4,213,366 | 7/1980 | Niimi et al. | 84/1.01 |
| 4,279,186 | 7/1981 | Deforeit | 84/1.01 |
| 4,338,843 | 7/1982 | Wise | 84/1.01 |
| 4,377,960 | 3/1983 | Okumura | 84/1.01 |

FOREIGN PATENT DOCUMENTS 1604547 12/1981 United Kingdom .

*Primary Examiner*—Stanley J. Witkowski
*Attorney, Agent, or Firm*—Wenderoth, Lind & Ponack

[57] ABSTRACT

A wave reading apparatus includes a wave generator for generating a plurality of wave signals, a read-out frequency generator for generating a plurality of read-out frequencies, a controller for controlling calculation, writing and reading of wave samples, a writing device, a plurality of buffer memories and a plurality of read-out devices. The controller informs requests of wave samples calculation to the wave generator in accordance with the read-out frequencies. The calculated wave samples are written through the writing device to the buffer memories and read out by the read-out device in accordance with the read-out frequencies, at least one of which is different in frequency from the remainder.

9 Claims, 22 Drawing Figures

TIMING PULSE GENERATOR (TPG)
CAL. REQ. DET. CONT.
WAVE CAL.
GATE
DAC
NOTE CLOCK SELECTOR (NCS)
NCG
MCK
NOTE DATA
NCK1
NCK8
REGISTER
CRF1
CRF8
READ-OUT DEVICES
TRS1
TRS8
NOTE DATA
OCTAVE DATA
KEY ON/OFF DATA
CF

FIG. 13.
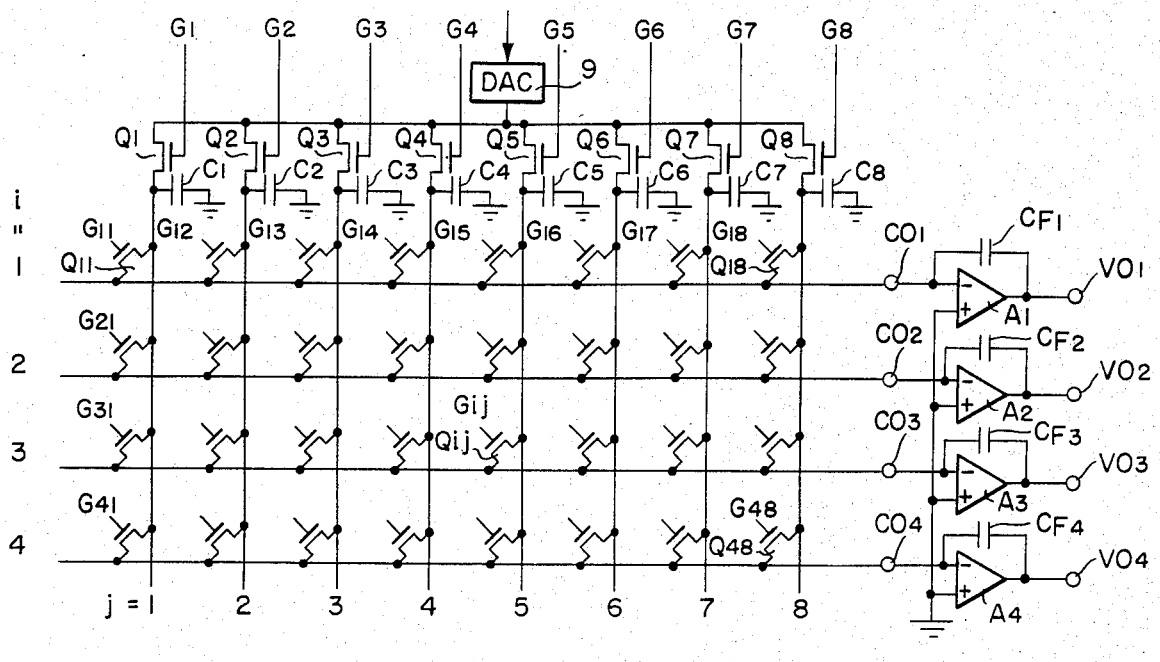
FIG. 14.
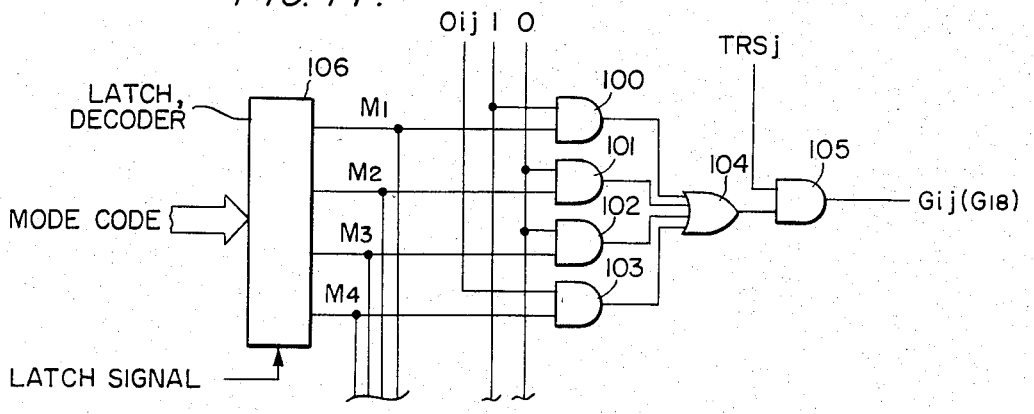
FIG. 15.
TABLE(a)
| i \ j | 1 | 2 | 3 | 4 | 5 | 6 | 7 | 8 |
|---|---|---|---|---|---|---|---|---|
| Sij1 | | | | | | | | |
| 1 | 1 | 1 | 1 | 1 | 1 | 1 | 1 | 1 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
TABLE (b)
| i \ j | 1 | 2 | 3 | 4 | 5 | 6 | 7 | 8 |
|---|---|---|---|---|---|---|---|---|
| Sij2 | | | | | | | | |
| 1 | 1 | 1 | 0 | 0 | 0 | 0 | 0 | 0 |
| 2 | 0 | 0 | 1 | 1 | 0 | 0 | 0 | 0 |
| 3 | 0 | 0 | 0 | 0 | 1 | 1 | 1 | 0 |
| 4 | 0 | 0 | 0 | 0 | 0 | 0 | 0 | 1 |
TABLE (c)
| i \ j | 1 | 2 | 3 | 4 | 5 | 6 | 7 | 8 |
|---|---|---|---|---|---|---|---|---|
| Sij3 | | | | | | | | |
| 1 | 1 | 1 | 1 | 1 | 0 | 0 | 0 | 0 |
| 2 | 0 | 0 | 0 | 0 | 1 | 1 | 1 | 1 |
| 3 | 0 | 0 | 0 | 0 | 0 | 0 | 0 | 0 |
| 4 | 0 | 0 | 0 | 0 | 0 | 0 | 0 | 0 |
TABLE (d)
| i \ j | 1 | 2 | 3 | 4 | 5 | 6 | 7 | 8 |
|---|---|---|---|---|---|---|---|---|
| Sij4 | | | | | | | | |
| 1 | O11 | - | - | - | - | - | - | O18 |
| 2 | O21 | - | - | - | - | - | - | O28 |
| 3 | O31 | - | - | - | - | - | - | O38 |
| 4 | O41 | - | - | - | - | - | - | O48 |
$$Gij = TRSj \cdot (Sij_1 \cdot M1 + Sij2 \cdot M2 + Sij3 \cdot M3 + Sij4 \cdot M4)$$

WAVE READING APPARATUS

BACKGROUND OF THE INVENTION

1. Field of the Invention

This invention relates to a wave reading apparatus, and more particularly to a multiple frequency wave reading apparatus for generating plural signals which have different frequencies for an electronic musical instrument.

2. Description of the Prior Art

An electronic musical instrument of keyboard type must simultaneously generates plural sound signals having different frequencies corresponding to respective keys on the keyboard for polyphonic music. A conventional electronic musical instrument has independent wave generators corresponding to respective keys on the keyboard. Another conventional electronic musical instrument has fewer wave generators than the number of the keys. A generator assigner scans the keyboard and sends a note code and octave code to the wave generator so as to generate a wave signal having the frequency of the note and the octave of a depressed key. The number of wave generators is usually eight to ten, corresponding to the number of human fingers. Still another conventional electronic musical instrument has one wave generator. The wave generator generates plural wave signals in a time-multiplexed operation.

When the wave generators generate the wave signals in the form of a digital code, the generated digital wave samples must be converted to an analog form by a digital-to-analog converter (DAC). The first conventional instrument of the above needs as many DACs as the number of keys. The second conventional instrument needs eight to ten DACs. The third conventional instrument may need only one DAC, but the plural wave signals must be summed in digital form before conversion. Since eight to ten wave signal data must be accumulated at once, a very high speed full adder is necessary. The summed data become larger than each separate data. The bit length of the DAC increases by three to four bits. Accordingly, an expensive DAC must be used. The sampling frequency of the eight to ten wave signals must coincide with each other. This is difficult limitation for a musical instrument, because frequencies of the 12 notes in an octave are different from each other. The ratio of the sampling frequency to the fundamental frequency of wave signal cannot be an integer or a simple fractional number. To solve this problem, the sampling frequency must be very high frequency or a calculation of a complex interpolation between two succeeding wave samples must be executed.

SUMMARY OF THE INVENTION

Therefore, an object of the present invention is to provide a novel wave reading apparatus in which the fundamental frequency of wave signal is asynchronous with a generation of wave samples, and the reading frequency of the wave samples in synchronous with the fundamental frequency. The generation of the wave samples can be done in a time-division-multiplexed (TDM) mode by a single wave calculator set. Only one DAC is used which operates in a TDM.

The above object can be accomplished by a wave reading apparatus of the present invention comprising: a wave generator which generates a plurality of wave sample signals; a read-out frequency generator which generates a plurality of read-out frequencies such as note clock frequencies; a controller which controls calculation, writing and reading of the wave sample signals; a writing device; a plurality of buffer memories; and a plurality of read-out devices. The controller informs occurrences of the requests of the wave samples to the wave generator in response to the readout frequencies. The wave generator generates the wave sample signals in response to the requests. The writing device writes the wave samples which are provided from the wave generator into the buffer memories. The reading devices read out the wave sample signals stored in the buffer memories in response to the frequencies of the reading signals having the reading frequencies. The buffer memories are provided for the plurality of read-out frequencies or the channels. The reading out operations are executed not in a serial mode but in a parallel mode, so that the reading signal pulses can occur simultaneously. The relationship among the read-out frequencies is not restricted, but the read-out frequencies can be changed freely for vibrato effect, gliding effect and portamento effect. Besides, these effects can be added to any one or more of the channels independently.

The writing to the buffer memories can be executed serially in response to the time slot. Therefore, at least one DAC is necessary for the plurality of channels. The DAC operates in an independent sequence for the channels. Therefore, even when the two or more keys are depressed simultaneously, interference between two sequences does not occur. In other words, intermodulation distortion does not occur. Accordingly, an inexpensive DAC, such as 8 bit DAC, can be used without being effected by intermodulation.

The sampling frequency, or the note clock frequency, can be an integer multiple of the fundamental frequency of the wave. The spurious spectra of aliasing and quantizing noises coincide with the harmonic frequencies of the fundamental frequency. Therefore, a plurality of very pure sounds can be obtained at the same time.

The above and other objects and features of the present invention will become apparent from the following detailed description of the invention considered together with the accompanying drawings in which:

BRIEF DESCRIPTION OF THE DRAWINGS

FIG. 6' is a timing diagram of the apparatus shown in FIG. 6;

FIG. 13 is a schematic circuit diagram of another embodiment of a buffer memory used in the present invention;

FIG. 14 is a schematic block diagram of a gate control circuit used in the present invention;

FIG. 15 shows logic tables for gate control;

DESCRIPTION OF THE PREFERRED EMBODIMENTS

Figure 1:
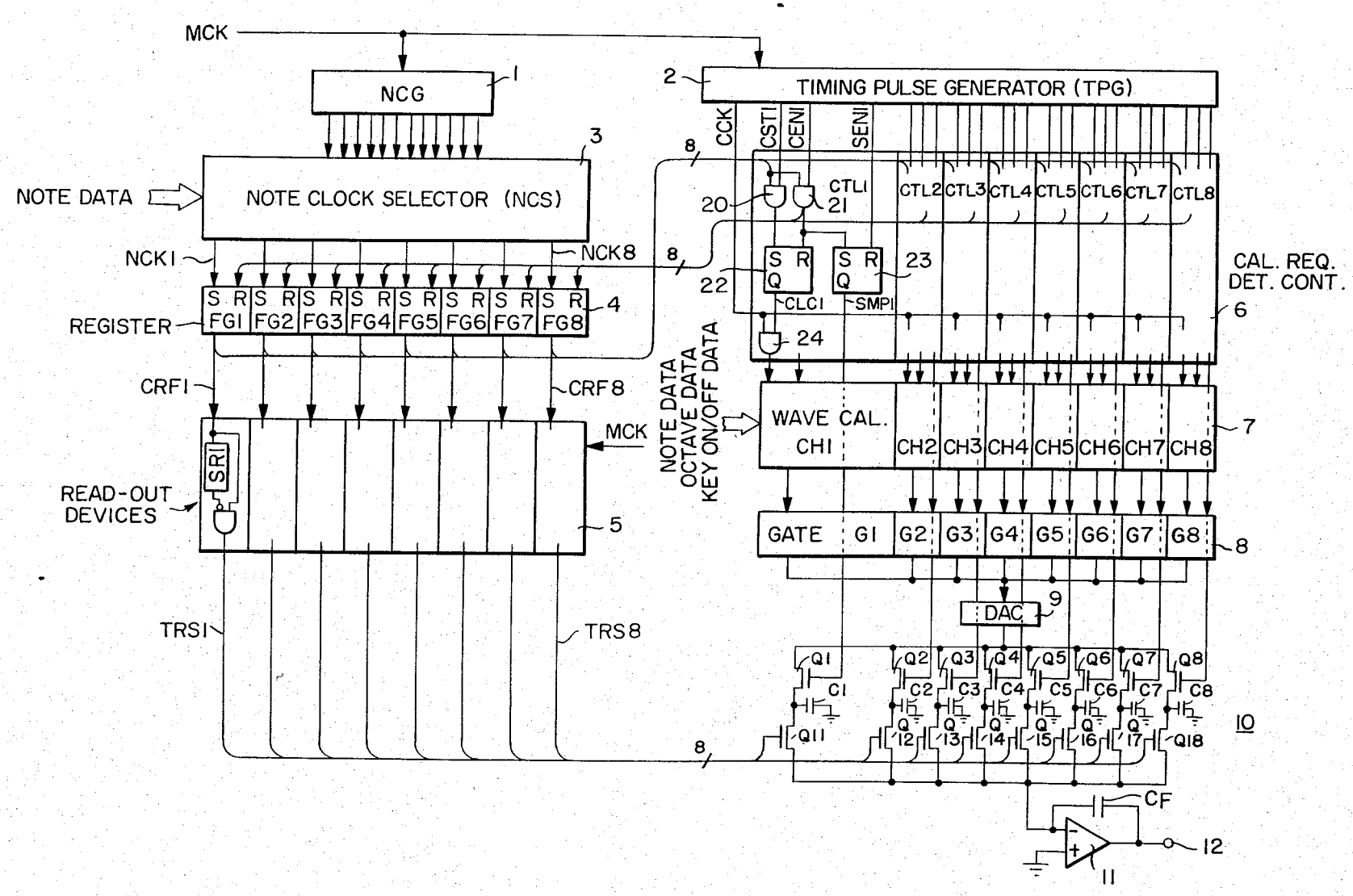
FIG. 1 is a schematic block diagram of an embodiment of a wave reading apparatus of the present invention.

Referring to FIG. 1, a note clock generator (NCG, hereafter) 1 divides a master clock signal (MCK, hereafter) and generates twelve note clock signals (C, C#, D, . . . , B). A timing pulse generator (TPG, hereafter) 2 generates necessary timing signals such as CCK, CST 1, CEN 1 and SEN 1. A note clock selector (NCS, hereafter) 3 receives note data, selects the note clock signals designated by the note data from the twelve note clock signals, and outputs the selected note clock signals. This embodiment can generate 8 wave signals simultaneously. Therefore, 8 note data are applied to the NCS 3 and eight note clock signals NCK 1~8 are output. Table 1 shows divisor numbers of NCG 1 and frequencies of the note clock signals.

TABLE 1

| NOTE | DIVISOR NUMBER | $C_7 \sim B_7$ [Hz] | NOTE CLOCK FREQUENCY [KHz] |
|---|---|---|---|
| $C_7$ | 478 | 4184.60 | 16.3784 |
| $C_7^{\#}$ | 451 | 4435.12 | 17.7405 |
| $D_7$ | 426 | 4695.40 | 18.7816 |
| $D_7^{\#}$ | 402 | 4875.72 | 19.9029 |
| $E_7$ | 379 | 5277.68 | 21.1107 |
| $F_7$ | 358 | 5587.26 | 22.3491 |
| $F_7^{\#}$ | 338 | 5917.87 | 23.6715 |
| $G_7$ | 319 | 6270.34 | 25.0814 |
| $G_7^{\#}$ | 301 | 6645.32 | 26.5813 |
| $A_7$ | 284 | 7043.10 | 28.1724 |
| $A_7^{\#}$ | 268 | 7463.58 | 29.8543 |
| $B_7$ | 253 | 7906.09 | 31.6244 |

$f_{MCK}$ = 8.00096 MHz

The note clock signals NCK 1~8 are applied to calculation request flag register (CRFR, hereafter) 4. The CRFR 4 is composed of eight RS flip-flops FG 1~8. The NCK 1~8 are applied to set terminals S of the FG 1~8, respectively. The FG 1~8 are set everytime when the NCK 1~8 are applied to and output signals of the FG 1~8 become "1". The output signals of the FG 1~8 are called calculation request flags (CRF 1~8). Calculation end signals (CEN 1~8) are applied to terminals R of FG 1~8. When the CEN 1~8 become "1", the CRF 1~8 become "0".

Read-out devices 5 are composed of eight blocks each of which receives CRF 1~8 and generates reading signals TRS 1~8 respectively. The reading signals TRS 1~8 are pulse signals having a predetermined width and starting at an edge of the CRF 1~8. Frequencies of the TRS 1~8 are the same as those of the NCK 1~8, respectively. The read-out devices 5 are composed of shift registers applied with MCK as a clock signal and AND gates. One input terminal of each of the AND gates is inverted as shown in FIG. 1.

A wave generator is composed of a calculation request detecting controller 6 and a wave calculator 7. The calculator request detecting controller 6 is composed of controller CTL 1~8 corresponding to the eight channels. The timing pulse generator TPG 2 generates a calculation start signal CST 1, a calculation end signal CEN 1, a sample end signal SEN 1 and a calculation clock signal CCK for the CTL 1. The CRF 1 is applied to one input terminal of each of AND gates 20 and 21. The signals CST 1 and CEN 1 are applied to the remaining input terminals of the AND gates 20 and 21, respectively. Output terminals of AND gates 20 and 21 are connected to set and reset terminals of a SR flip-flop (FF, hereafter) 22, respectively. The output terminals of AND gate 21 is also connected to a set terminal of a SR FF 23 and to a reset terminal of a SR FF FG 1. The signal SEN 1 is applied to a reset terminal of the SR flip-flop 23. An output signal from a Q terminal of the SR FF 22 is a calculation cycle signal CLC 1. The signal CLC 1 is applied to an AND gate 24 and the calculation clock signal CCK is gated by the CLC 1 in the AND gate 24. An output signal of the SR FF 23 is a sampling signal SMP 1. The signal SMP 1 is applied to a gate G1 in a writing device 8 and to a switch $Q_1$ in buffer memories 10.

The wave calculator 7 is composed of eight channels CH 1~8. Each channel receives note data, octave data and key on/off data and generates wave samples of musical sound wave having a correct note and octave. The calculation is done under the signal CCK. The wave samples are applied to the gates G1~8.

The writing device 8 is composed of the gates G1~8 and a digital-to-analog converter DAC 9. The wave calculator 7 completes calculation and outputs valid wave samples. The valid wave samples are gated and applied to the DAC 9. When the sampling signals SMP 1~8 are "0", the gates G1~8 become high output impedance, so that these gates do not affect the other gates. An output signal of the DAC 9 is applied to the buffer memories 10.

The buffer memories 10 are composed of writing switches Q1~Q8, capacitors C1~C8 and reading switches Q11~Q18. The signals SMP 1~8 are applied to the writing switches Q1~Q8 and the reading signals TRS 1~8 are applied to the reading switches Q1~Q8, respectively. When the signal SMP 1 becomes "1", the switch Q1 turns "ON". An output voltage $V_1$ of the DAC 9 charges up the capacitor C1 and the voltage $V_1$ is held by the capacitor C1 after the signal SMP 1 becomes "0". When the signal TRS 1 becomes "1", the switch Q11 turns "ON". The charges in the capacitor C1 are transferred to a capacitor $C_F$. The capacitor $C_F$ and an operational amplifier 11 compose a summing integrator for holding the charges from the capacitors C1~C8. An output voltage of the output terminal 12 is $-V_1(C1/C_F)$.

Figure 2:
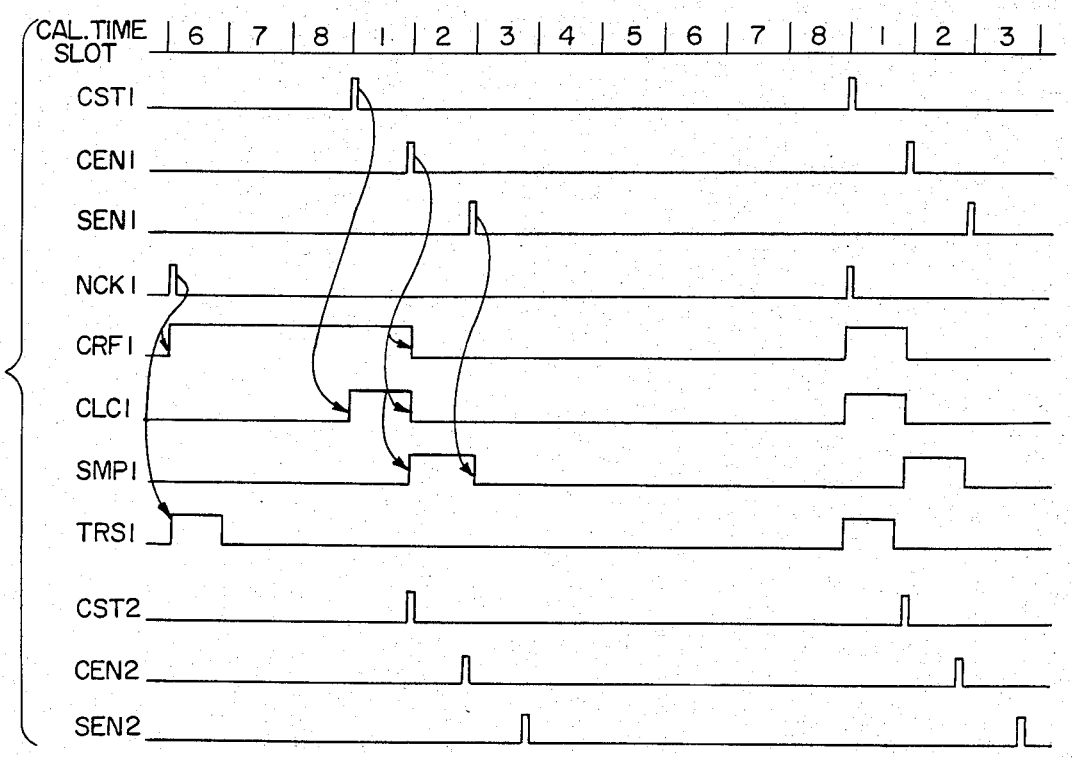
FIG. 2 is a timing diagram of the apparatus shown in FIG. 1.

FIG. 2 shows timing diagrams of the embodiment shown in FIG. 1. Referring to FIG. 2, calculation time slots 1~8 are prepared. The calculation start signal CST 1 appears at the initial point of the calculation time slot 1. The calculation end signal CEN 1 appears at the end of the same slot 1. The sample end signal SEN 1 appears at the end of the time slot 2. These signals CST 1, CEN 1 and SEN 1 are produced cyclically corresponding to 8 time slots. The note clock signal NCK 1 is provided asynchronously with the time slots. The frequency of the signal NCK 1 corresponds to the note data, and is shown in Table 1. The signal NCK 1 sets the calculation flag register FG 1 and the signal CRF 1 becomes "1". The shift register SR 1 delays the signal CRF 1 and the signal TRS 1 is generated. The pulse width of the signal TRS 1 is narrower than the width of the time slot. The signal CFR 1 is maintained as "1" and during the time slot 1, the calculation start signal CST 1 sets the SR FF 22 through the AND gate 20, so that the calculation cycle signal CLC 1 becomes "1". The signal CLC 1 opens the AND gate 24. The calculation clock CCK is applied to the wave calculator CH 1 in the wave calculator 7. The wave calculator CH 1 generates a wave sample. The calculation of the wave sample is completed during the time slot 1. When the signal CEN 1 is generated, the signal CRF 1 is still "1" and the CEN 1 resets the SR FF 22, sets the SR FF 23 and resets the SR FF FG 1. The signal CLC 1 becomes "0" and closes the AND gate 24. The signal CCK is blocked. The calculation request flag CRF 1 is reset to "0". This means that a calculation of the wave sample corresponding to the request of the calculation has been executed. The SR FF FG 1 in the calculation request flag register 4 watches and waits for the next note clock signal NCK 1. The SR FF 23 is set, then the signal SMP 1 becomes "1", opens the gate G1 and the wave sample is applied to the DAC 9. At the same time, the switch Q1 opens and the output voltage $V_1$ is applied to the capacitor C1. After the capacitor C1 is charged up to the voltage $V_1$, the sample and signal SEN 1 appears and resets the SR FF 23 so as to make the SMP 1 "0". The gate G1 and the switch Q1 become "OFF". The capacitor C1 holds the voltage $V_1$. After that, the next note clock signal NCK 1 occurs, the SR FF FG 1 and the signal TRS 1 becomes "1". Then, the switch Q11 opens and the charge in the capacitor C1 is transferred to the capacitor $C_F$.

As mentioned above, after the note clock signal NCK 1 occurs, the wave sample calculated and stored in the preceeding time slot is read out and the CFR 1 is set. When the time slot 1 occurs, the calculation of wave sample of the channel 1 is executed. The wave sample is converted to analog voltage and is written to the buffer memories 10 in the time slot 2.

The frequency of the NCK 1 for channel 1 depends upon the note data as shown in Table 1. When the NCK 1 is low in frequency, the time slot 1 occurs before the CRF 1 is set. In this case, a calculation of a wave sample is not necessary, so that the signal CLC 1 is kept "0". On the contrary, when the NCK 1 is too high in frequency, the next NCK 1 occurs before the CRF 1 is reset. The period of the NCK 1 must be larger than the duration of ten time slots.

Figure 3:
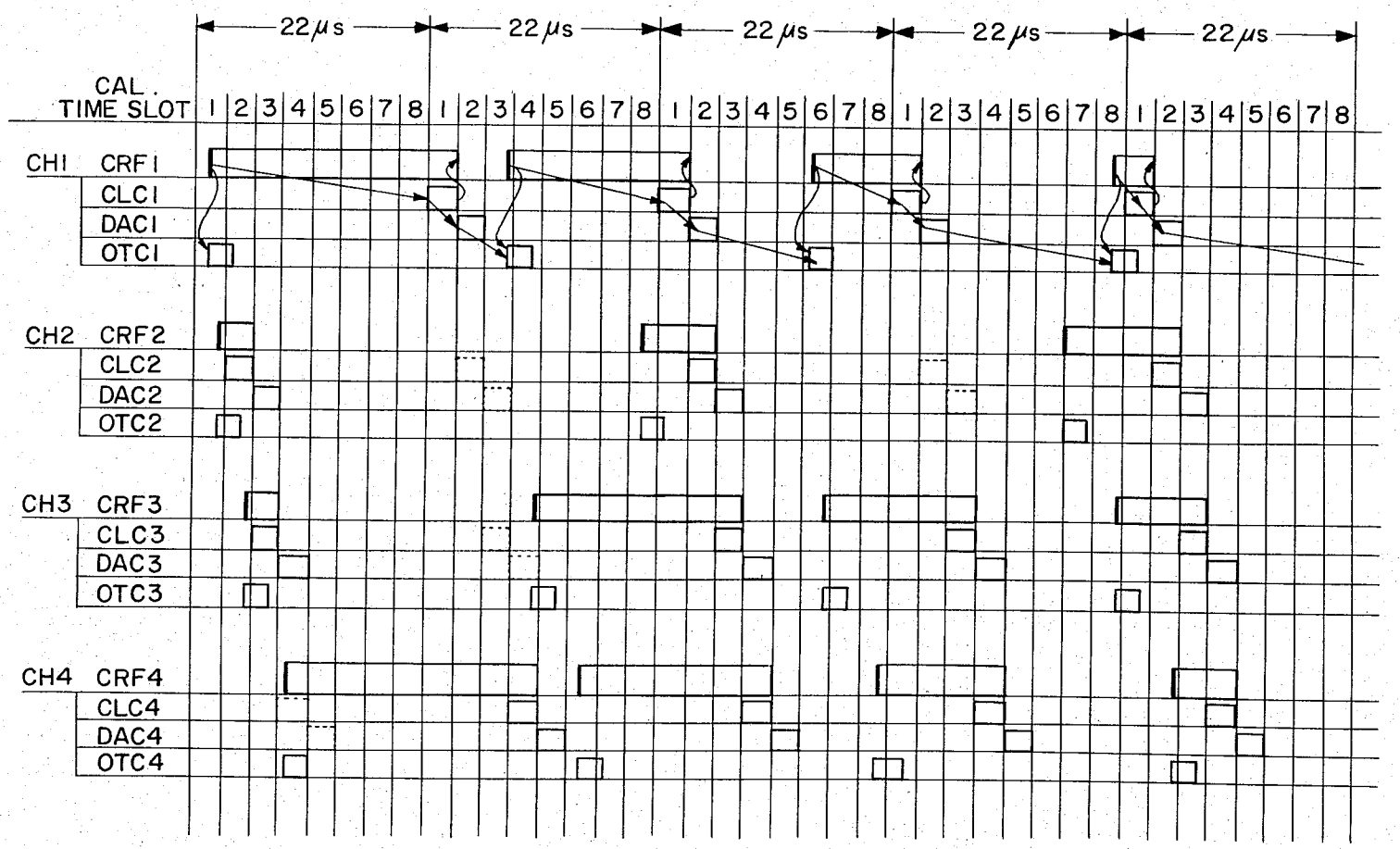
FIG. 3 is another timing diagram of the apparatus shown in FIG. 1.

FIG. 3 shows examples of the CRF 1~4, the CLC 1~4, the timings of the digital to analog conversion (DAC 1-4) and the timings of reading ($\overline{\text{O}}$TC 1~4) for various frequencies of the note clock signal NCK 1~4. The DAC 1~4 correspond to the signals SMP 1~4. The $\overline{\text{O}}$TC 1~4 correspond to the signals TRS 1~4. The thick lines at the rising edges of the CRF 1~4 correspond to occurrences of the NCK 1~4. The calculations of the wave samples are executed at the calculation time slot 1~8. In the CH 2, the period of the NCK 2 is long, the calculation is executed in almost every other slot of the time slot 2. At the dot lined part, the CRF 2 is "0", so the calculation is not executed.

In the CH 3, the period of the NCK 3 is short and the NCK 3 is generated at DAC 3, the calculation being delayed one cycle actually. In the CH 4, the NCK 4 is generated at the time slot 4 and the calculation is delayed one cycle of the time slot 4. In every case, the readings of the wave samples are executed periodically corresponding to the occurrence of the NCK 1~4.

As mentioned above, the wave reading apparatus of the present invention can read and generate the wave samples of the respective channels independently in frequency, even though the cycle of the inner calculations and the outer reading frequency are asynchronus with each other because of plural reading frequencies. The reading timings coincide with each other.

Referring to FIG. 1, the wave calculators CH1~CH8 and the gates G1~G8 are employed independently. Referring to FIG. 3, the calculation time slots are not overlapped and the writings are also not overlapped. Therefore, the calculation can be executed in time division multiplication (TDM, hereafter).

Figure 4:
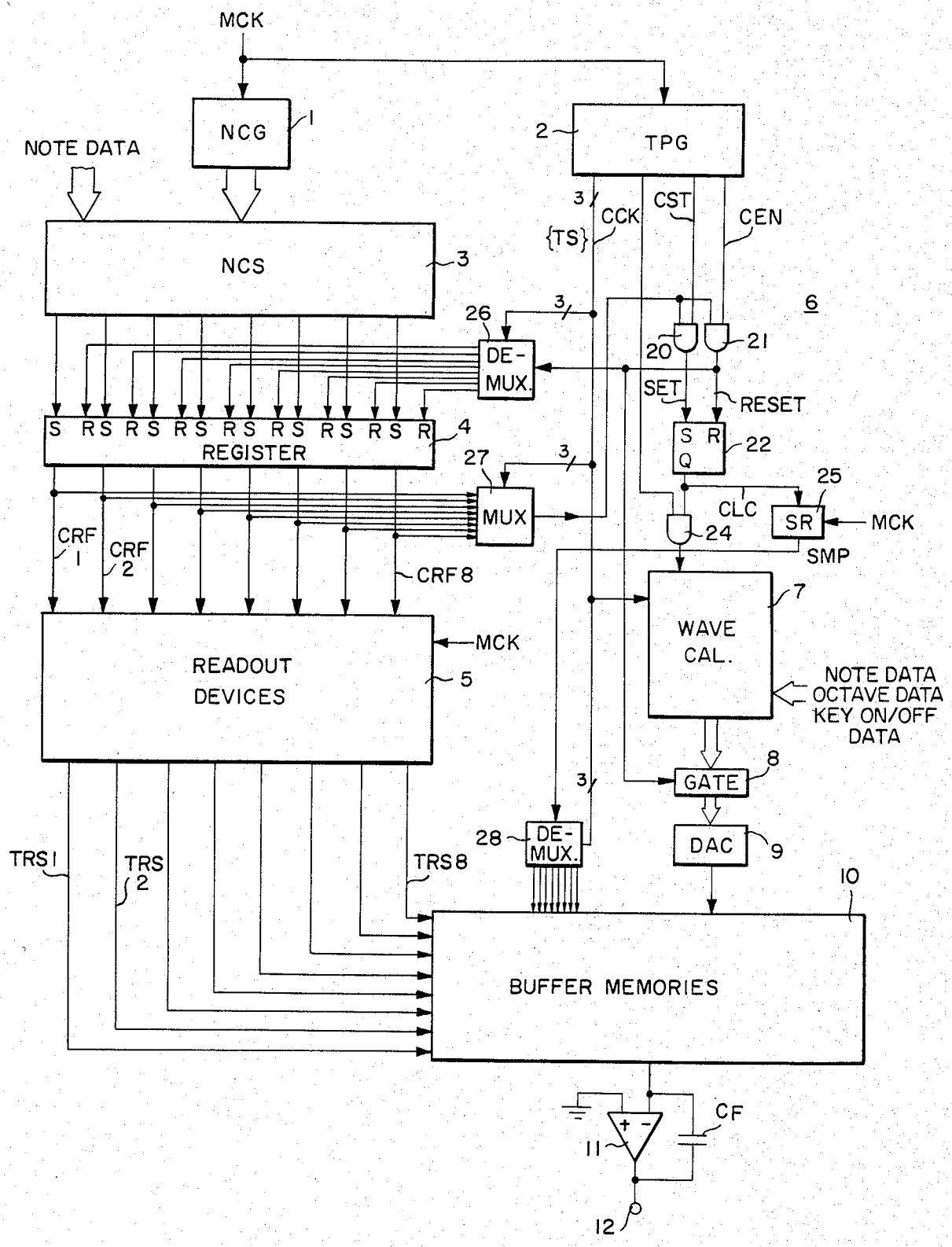
FIG. 4 is a schematic block diagram of another embodiment of a wave reading apparatus of the present invention.
Figure 5:
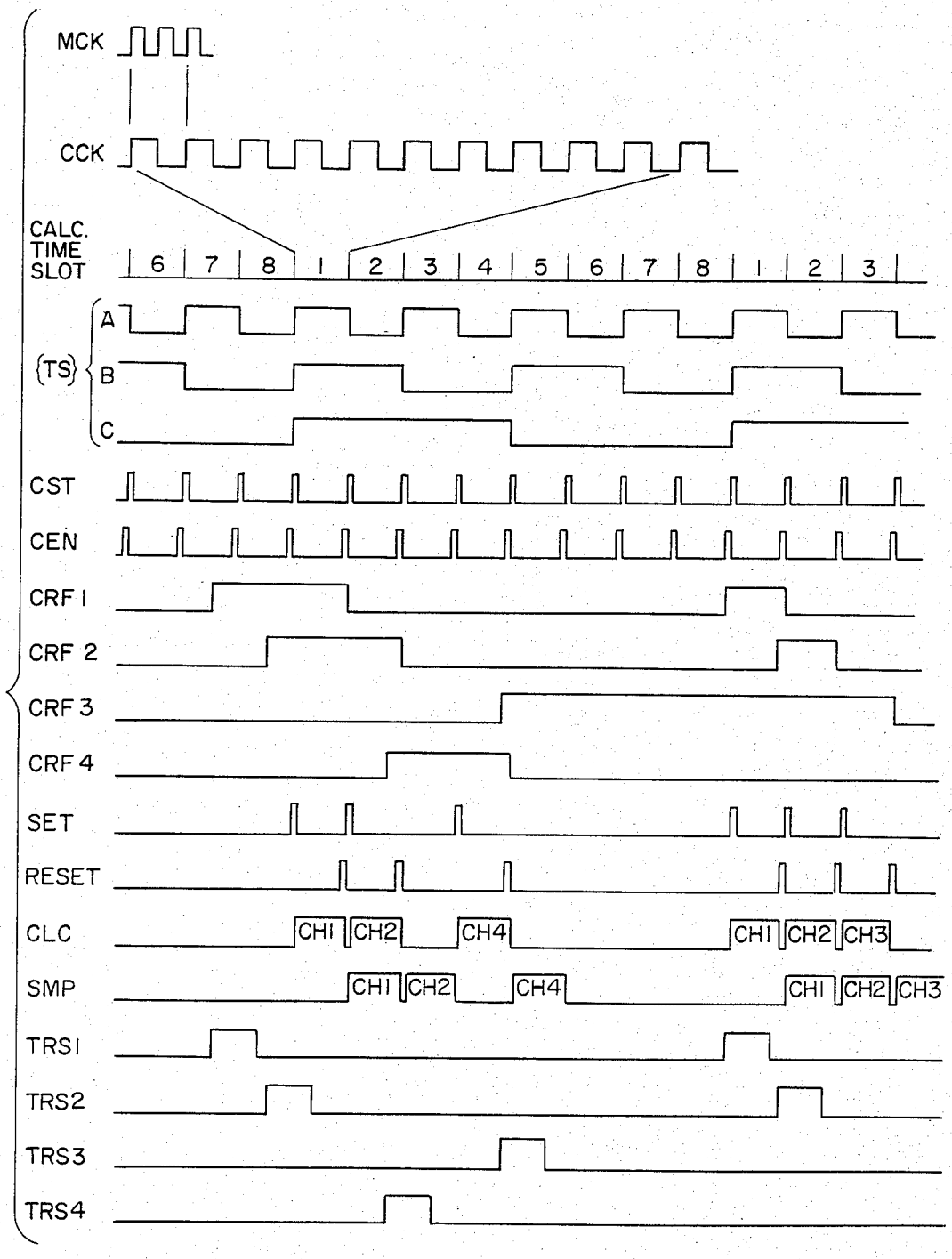
FIG. 5 is a timing diagram of the apparatus shown in FIG. 4.

FIG. 4 shows another embodiment of a wave reading apparatus of the present invention in which the calculation request detecting controller 6 and the wave calculator 7 operate by the TDM method. FIG. 5 shows timing charts of the embodiment of FIG. 4. Referring to FIG. 4, the components having same function as these of FIG. 1 are numbered with the same number.

Referring to FIG. 4, a timing pulse generator TPG 2 generates a calculation clock signal CCK, a calculation start signal CST and a calculation end signal CEN as shown in FIG. 5. Signals (TS) are 3 bit codes (A, B, C) designating one of the eight calculation time slots. These signals are applied to the calculation request detecting controller 6 which is composed of AND gates 20, 21, 24, a SR FF 22, a shift register 25, a multiplexer 27 and demultiplexers 26, 28. A wave calculator 7 operates in a time division multiplexed mode. Wave samples from the wave calculator 7 are applied to the DAC 9 through a latch 8.

Referring to FIG. 5, the master clock signal MCK is divided so as to produce the calculation clock signal CCK. Each of the calculation time slots 1~8 is composed of ten CCK signals. The time slots 1~8 are designated by a {TS} code {A, B, C}={1, 1, 1} means the time slot 1. The first CCK signal of the 10 CCK signals in a time slot is the CST signal. The last of the 10 CCK signals is the CEN signal.

The CRF 1~8 signals are set on the calculation flag register 4. The CRF 1~8 are scanned by the multiplexer 27. When {TS} is {1, 1, 1}, the CRF 1 is selected and applied to the AND gates 20 and 21. When the CRF 1 is "1", the SR FF 22 is set and the CLC signal becomes "1". The CCK signal is applied to the wave calculator 7 through the AND gate 24. The channel code {TS} is applied to the wave calculator 7. Therefore, the wave calculator 7 executes a wave calculation according to the note data and octave data of channel 1. The wave calculation is completed at the last of the 10 CCK signals and the wave sample datum is stored in the latch 8. The latching signal for the latch 8 is the reset signal from the AND gate 21. The RESET signal is applied to the SR FF 22 from the AND gate 21 and the CLC signal becomes "0". The demultiplexer 26 applies the RESET signal to the FG 1 of the calculation request flag register 4 and resets the FG 1. The CRF 1 becomes "0". The CLC signal has pulse width of 9 CCK pulses. This signal is delayed by 20 MCK signal, i.e. one time slot by the shift register 25. The delayed signal SMP is applied to the demultiplexer 28. At this time, {TS} is {0, 1, 1}. The demultiplexer 28 selects buffer memories CH 1 by the channel code {TS}={0, 1, 1}. The switch Q1 opens and applies an output voltage of DAC 9 to the capacitor C1.

When the channel code {TS} becomes {0, 1, 1} and if the CRF 2 is "1", then the calculation of the time slot 2 is executed in the same way as that of the time slot 1, as shown in FIG. 5. When the {TS} is {1, 0, 1} and the CRF 3 is "0", the SR FF 22 is not set. The CLC signal remains "0" and no calculation is executed. The SMP signal is "0" so that the sampling is not executed and the previous sample signal is maintained in the buffer memories of the channel 3.

Referring to FIG. 4, when the NCK 1~8 generate at the respective channel, the reading signals TRS 1~8 are produced and they read out the voltages $V_1 \sim V_8$ of the capacitor C1~C8 in the buffer memories 10, as described in FIG. 1.

The note data, octave data and key on/off data are supplied from a generator assigner. The generator assigner scans the keyboard, detects the depressed key and the note name and the octave, and assigns one of the eight channels to the detected key. This principle and the embodiment are well known.

In the wave calculator 7, the wave sample is calculated in ten CCKs in the embodiment of FIG. 4. When the wave calculator 7 only reads out the wave samples in a wave memory, the wave sample can be generated only by an address increment and memory read out. Therefore, ten CCKs are not necessary.

The wave calculator 7 is not restricted to a specific embodiment, and any wave generating method can be applied to the present wave reading apparatus of the invention. For example, the wave calculator 7 may generate analog sample wave signals, as an analog music synthesizer or as an analog computer.

Figure 6:
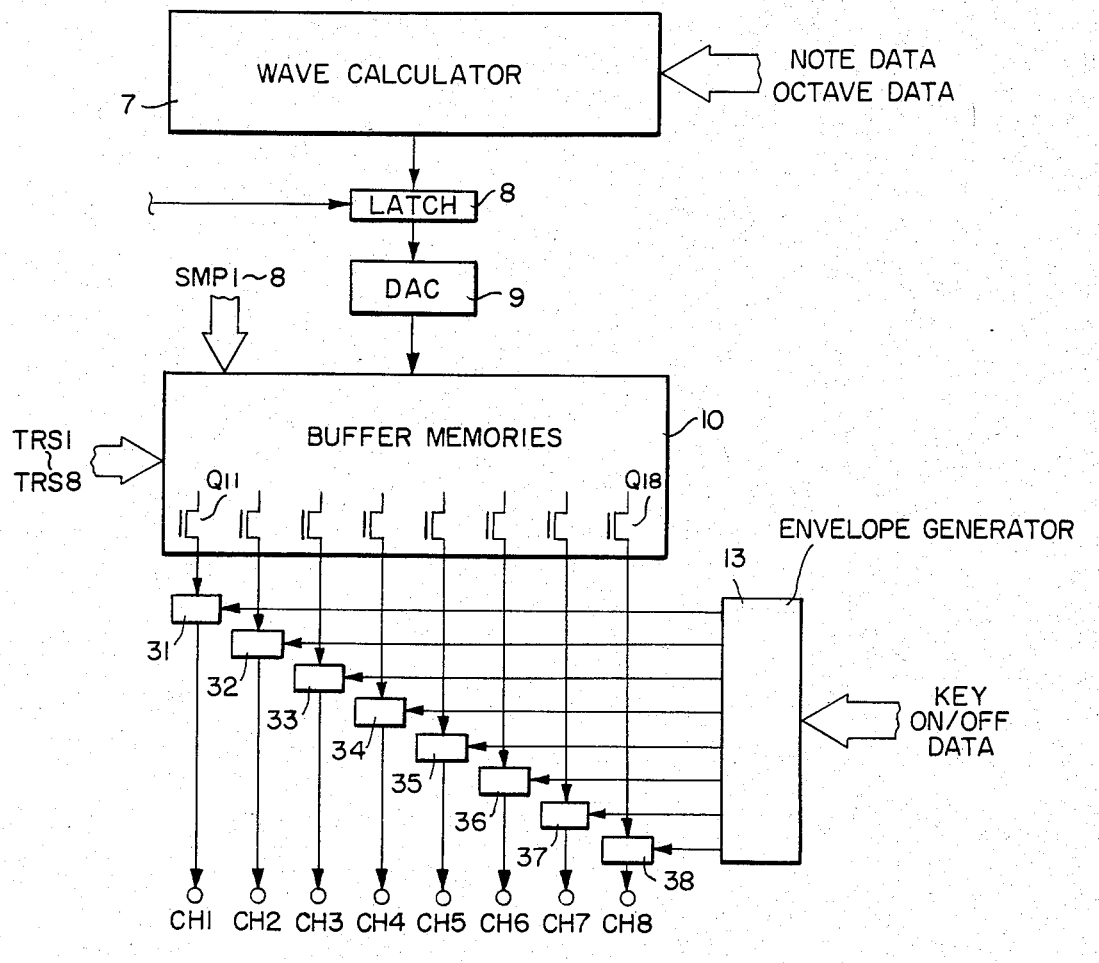
FIG. 6 is a schematic block diagram of a further embodiment of a wave reading apparatus of the present invention.
Figure 6:
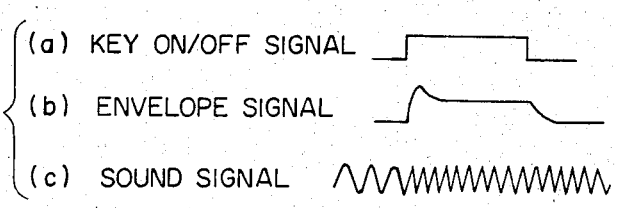

The data stored in the buffer memories 10 shown in FIGS. 1 and 4 are read out and the output signals are summed at the integrating circuit. The charges in the capacitors C1~C8 can be read out independently as shown in FIG. 6. Referring to FIG. 6, the buffer memories 10 put out charges of the respective channels through the transistor switches Q11~Q18 independently. Analog multipliers 31–38 multiply wave signals by envelope signals. The envelope signals are generated by an envelope generator 13. In the wave calculator 7, wave samples without an envelope can be generated. FIG. 6′ illustrates the key ON/OFF, envelope, and sound signals.

Figure 7:
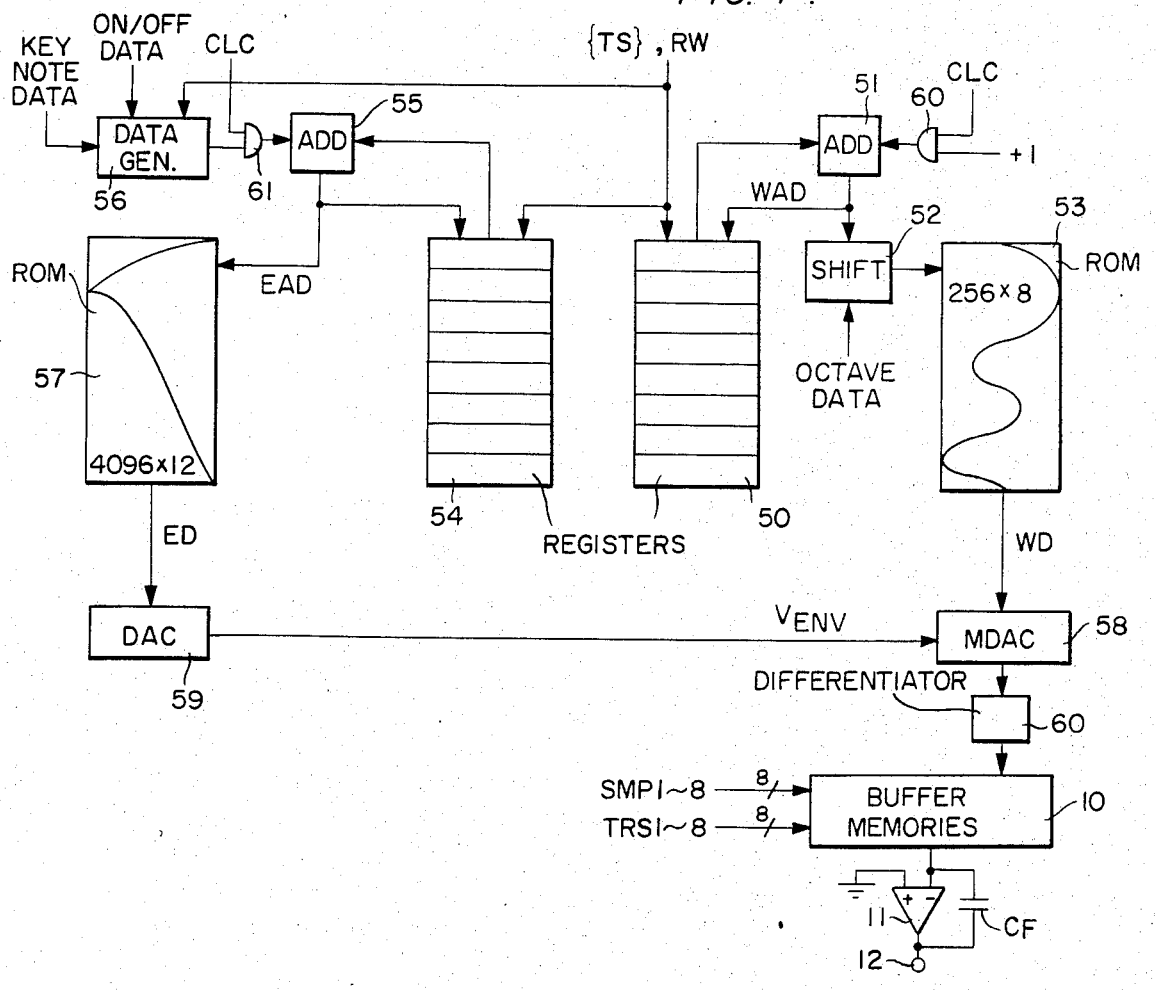
FIG. 7 is a schematic block diagram of a still further embodiment of a wave reading apparatus of the present invention.

FIG. 7 shows another embodiment of a wave calculator 7. Referring to FIG. 7, an address register 50 stores wave address data WAD. The WAD is composed of 8 bits and prepared for eight channels. The WAD designates an address of a ROM (read only memory) 53. The ROM 53 stores wave samples of a musical sound signal. The WAD is applied to an adder 51 and incremented by 1. An output of the adder 51 is applied to a shifter 52. An octave datum controls the shifting amount of bits. The ROM 53 is organized by 8 bits×256 words and stores samples of one cycle of musical sound signals. The calculation time slot code, i.e. the channel code {TS} and a read/write control signal R/W are applied to the wave address register 50. The {TS} code designates one word of the wave address register 50. The R/W becomes "1" and the designated WAD is read out and increased by 1 at the adder 51. Then, the R/W becomes "0" and the incremented WAD is written in the wave address register 50. When the CLC signal is "0", an AND gate 60 blocks "+1" data and the WAD does not increase. When the shifter 52 shifts the WAD by one bit left, an address data applied to the ROM 53 increases by two. Therefore, the samples in the ROM 53 are read every other sample. The frequency of a generated wave signal is thus doubled. The ROM 53 provides wave sample data WD to a multiplying digital-to-analog converter MDAC 58. An envelope address register 54 has eight registers for storing envelope address data EAD of respective channels. The {TS} code and the R/W signal control the address of the registers and the read/write operation. An incremental data generator 56 receives the key on/off data, the note data and the octave data and generates incremental data corresponding to the note, the octave and the time slot code {TS}. An adder 55 sums the EAD and the incremental datum. The sum is a new EAD. The new EAD is provided to the envelope address register 54 and an envelope memory ROM 57. The ROM 57 stores whole envelope data from build up portion to release portion of an envelope.

When a key is depressed, the key on/off data becomes "1" and a register in the envelope address register 54 corresponding to an assigned channel is cleared. An incremental datum ΔEAD corresponding to the note of the depressed key is added to the EAD (initially, EAD=0). The sum, EAD+ΔEAD, is stored in the register and is applied to the ROM 57. This sum datum reads out an envelope data ED. When the calculation cycle signal CLC is "0", the EAD does not increase. As mentioned above, when the key is depressed, the ED is generated from the build up to release of the envelope. The ED is applied to a digital-to-analog converter DAC 59. The DAC 59 produces an analog voltage of an envelope signal $V_{ENV}$. The envelope data ED is generated in time division multiplexed mode, so the voltage $V_{ENV}$ changes synchronously with the time slot, as well as the wave data WD.

The envelope signal $V_{ENV}$ is applied to the MDAC 58. The MDAC 58 outputs a voltage $V_{ENV}$.WD which is the product of the wave data in the ROM 53 and the envelope data in the ROM 57, the voltage being synchronous with the time slots 1~8. The voltage $V_{ENV}$.WD is applied to the buffer memories 10 synchronously with the time slots, i.e. with the SMP 1~8, and read out in response to the TRS 1~8 signals.

The embodiment shown in FIG. 7 has a feature that the MDAC 58 can multiply the wave data by the envelope data without using digital multiplication. A further multiplying DAC can be added between the DAC 59 and the MDAC 58 or at the output of the MDAC 58. The added MDAC can control the level of the product voltage. If the digital level data are provided to the added MDAC synchronously with the time slots, the level of the voltage can be controlled independently for each of the eight channels. The digital level data can be the data corresponding to strength of the key depression. Then, the piano/forte can be added to the sound signals.

The buffer memories 10 are described in the following. Referring to FIGS. 1 and 4, the outputs of the buffer memories 10 are fed to the operational amplifier 11 and the feedback capacitor $C_F$. The operational amplifier 11 and the feedback capacitor $C_F$ add the outputs of the buffer memories 10 and hold them. The capacitor $C_F$ holds the voltage between its terminals. Therefore, the read sample voltage is held on the capacitor. Accordingly, the voltage stored in the buffer memories must be a differential voltage of succeeding two wave samples. The wave calculator 7 should output:

$$WD(nT)-WD(nT-T),$$

wherein the WD(nT−T) is a previous wave sample and the WD(nT) is a present wave sample. Referring to FIG. 7, the buffer memories 10 must be provided with the differential voltage. A differentiator 60 produces the differential voltage.

Figure 8:
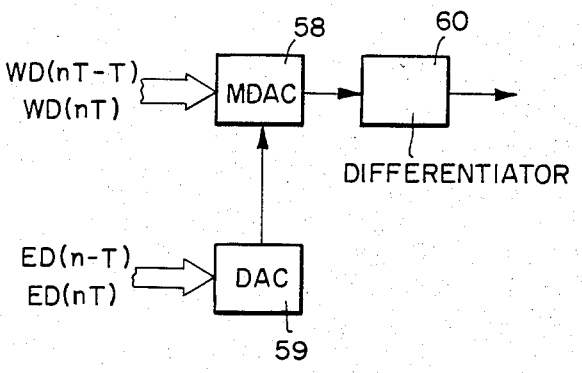
FIG. 8 is a schematic block diagram of a differential sample calculator used in the present invention.
Figure 9:
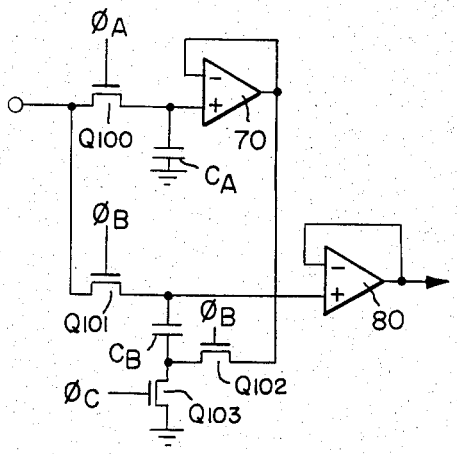
FIG. 9 is a schematic circuit diagram of a differentiator used in the present invention.
Figure 10:
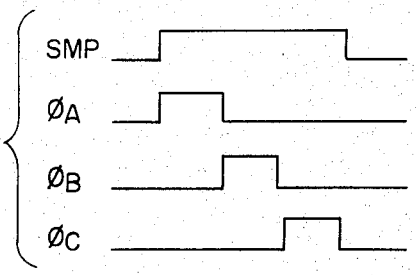
FIG. 10 is a timing diagram of the differentiator shown in FIG. 9.

FIG. 8 shows a block diagram of the differential sample calculator, FIG. 9 shows an example of the differentiator 60 and FIG. 10 shows timing charts of the same. Referring to FIG. 8, the wave sample data WD(nT−T) and WD(nT) are applied to the MDAC 58. The envelope data ED(nT−T) and ED(nT) are applied to the DAC 59. The previous sample data WD(nT−T) and ED(nT−T) are provided at $\phi_A$ and the present sample data WD(nT) and ED(nT) are provided at $\phi_B$. Referring to FIG. 9, a switch $Q_{100}$, a capacitor $C_A$ and a operational amplifier 70 compose a sample-hold circuit for holding a voltage V(nT−T) which is the product of the WD(nT−T)×ED(nT−T). The present product of the WD(nT)×ED(nT) is applied to a capacitor $C_B$ through a switch $Q_{101}$ at $\phi_B$ as the voltage V(nT). At this timing, the voltage V(nT−T) is applied to another terminal of the capacitor $C_B$ through a switch $Q_{102}$. Therefore, the voltage between two terminals of the capacitor $C_B$ is expressed as:

$$\Delta V(nT)=V(nT)-V(nT-T).$$

At $\phi_C$, a switch $Q_{103}$ becomes "ON" and the differential voltage ΔV(nT) is applied to the buffer memories 10 through an amplifier 80.

Figure 11A:
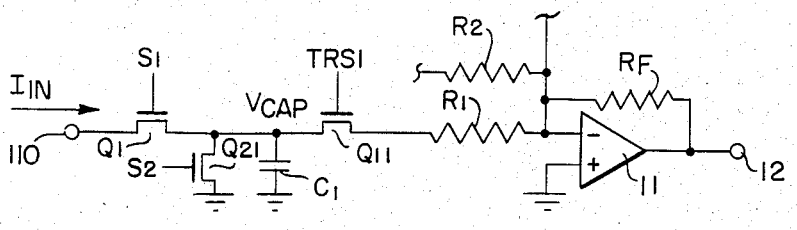
FIGS. 11A and 12A are schematic circuit diagrams of embodiments of buffer memories used in the present invention and FIGS. 11B and 12B are respectively timing charts thereof.
Figure 11B:
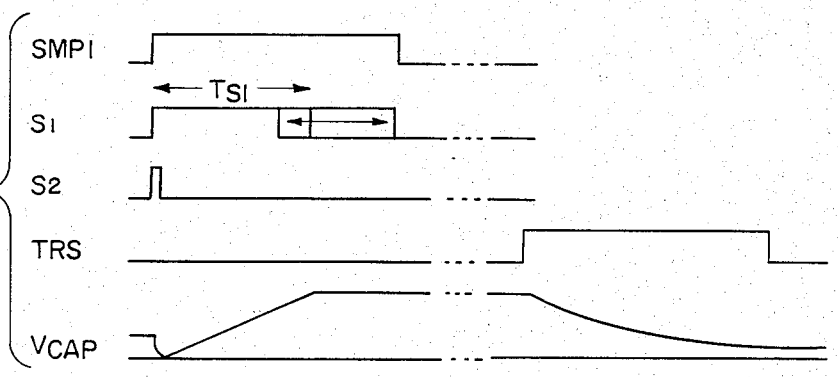

FIG. 11A shows another example of the buffer memories 10. Referring to FIG. 11A $Q_1$, $Q_{11}$, $Q_{21}$ are switches. Resistors $R_1$, $R_2$ are summing resistors. An operational amplifier 11 and a resistor $R_F$ compose a summing amplifier. The resistors $R_1$ and $R_2$ are provided for the channel 1 and 2, respectively. FIG. 11B shows waveforms of various points in FIG. 11A. An input current $I_{1N}$ representing a wave sample datum is applied to an input terminal 110 from the DAC. The switch $Q_1$ opens during $T_{S1}$ by a gate signal $S_1$ and charges the capacitor $C_1$. Before that, the switch $Q_{21}$ opens at the rising edge of $T_{S1}$ so that the capacitor $C_1$ is discharged. Therefore, voltage $V_{CAP}$ becomes:

$$V_{CAP}=(I_{1N}\cdot T_{S1})/C$$

during $T_{S1}$. When the reading signal TRS1 comes to a gate of the switch $Q_{11}$, the switch $Q_{11}$ opens and the charge on the capacitor $C_1$ is discharged through the resistor $R_1$. A discharging current flows through the resistor $R_1$ and $R_F$. An output voltage is obtained at a terminal 12. A pulse width of $T_{S1}$ is determined to be inversely proportional to the note clock frequency of the channel 1. When the note clock frequency is high, the frequency of the wave sample is high. If energy of the every wave sample is the same, even though the note clock frequency is different, the level of the output signal becomes proportional to the frequency of the note clock. To prevent this inconvenience, the pulse width $T_{S1}$ is changed so as to be inversely proportional to the note clock frequency. The writing signal $S_1$ can be obtained by selecting one of 12 different pulses generated by 12 monostable multivibrators.

Figure 12A:
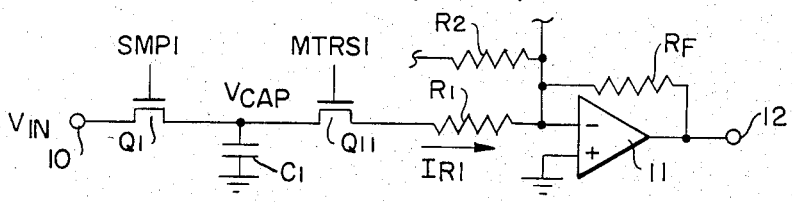
Figure 12B:
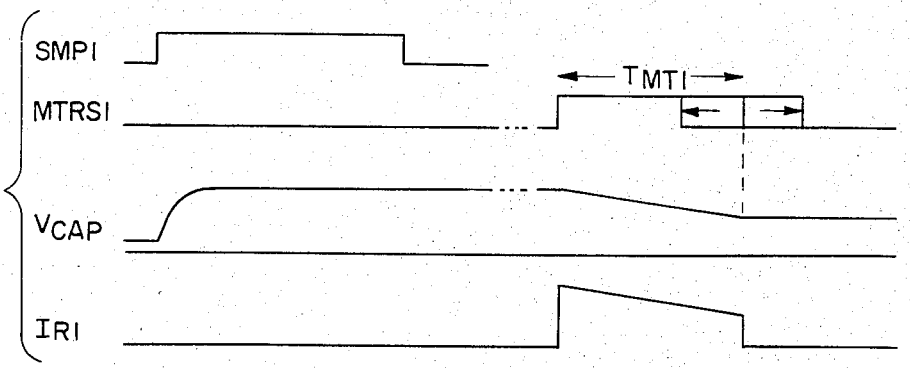

FIG. 12A shows another embodiment of the buffer memories 10. FIG. 12A is a circuit diagram and FIG. 12B is a corresponding timing diagram. A wave sample voltage $V_{IN}$ is applied to the input terminal 110. The sampling signal SMP1 charges up the capacitor C1. A reading signal $MTRS_1$ opens the switch $Q_{11}$. A current $I_{R1}$ flows through the switch $Q_{11}$, the resistor $R_1$ and $R_F$. An output voltage appears at the output terminal 12. The pulse width $T_{M1}$ of the signal $MTRS_1$ is inversely proportional to the note clock frequency. The higher the note clock frequency, the smaller the $I_{R1}$ and the larger the frequency of the sampling frequency. Therefore, the level of the output signal is maintained almost constant regardless of the note clock frequency.

Referring to FIGS. 11A and 12A, the summing amplifier has no holding function, and the input signal need not be a differential voltage.

FIG. 13 shows another embodiment of the buffer memories 10 which has four independent output terminals $VO_1 \sim VO_4$. Any channel of the eight channels can be connected to one of the four output terminals. Referring to FIG. 13, the DAC 9, the writing switches Q1∼Q8 and the capacitors C1∼C8 are same as shown in FIG. 1. The switches $Q_{ij}$ (i=1, 2, 3, 4, j=1∼8) are connected at cross points of column and row lines. The gates of the switches Q1∼Q8 are provided with the sampling signals SMP 1∼8. The four row lines of the matrix are connected to four integrators through terminals $CO_1 \sim CO_4$. The integrators are composed of the operational amplifiers $A_1 \sim A_4$ and the capacitors $C_{F1} \sim C_{F4}$. The gate $G_{ij}$ of the switch $Q_{ij}$ are provided with read out signals generated by a selecting circuit as shown in FIG. 14. The selecting circuit as shown in FIG. 14 selects one switch $Q_{ij}$ out of each row and provides the read out signals TRS 1∼8. A decoder latch 106 receives a 2 bit mode code provided from an microcomputer controller, stores and decodes them to 4 signals, one of which is "1". The 4 signals correspond to modes $M_1$, $M_2$, $M_3$, $M_4$. The signals $M_1 \sim M_4$ are applied to 4 AND gates 100, 101, 102, 103. The remaining input terminals of the AND gates 100∼103 are provided with "0", "1" or "$O_{ij}$" according to Tables (a), (b), (c) and (d) shown in FIG. 15. The output signals of the AND gates 100∼103 are summed logically by an OR gate 104. An output signal of the OR gate 104 either passes or blocks the read out signal $TRS_j$. An output signal of an AND gate 105 controls $G_{ij}$. $G_{ij}$ and can be expressed by the following equation:

$$G_{ij}=TRS_j(S_{ij1}\cdot M_1+S_{ij2}\cdot M_2+S_{ij3}\cdot M_3+S_{ij4}\cdot M_4)$$

(1) If $M_1=1$ (mode $M_1$), $$G_{ij}=TRS_j\cdot S_{ij1}$$

Referring to Table (a) in FIG. 15, all the channels are connected to the output terminal $VO_1$.

(2) If $M_2=1$ (mode $M_2$), $$G_{ij}=TRS_j\cdot S_{ij2}$$

The channels 1 and 2 are connected to $VO_1$. The channels 3 and 4 are connected to $VO_2$. The channels 5 and 6 are connected to $VO_3$. The channels 7 and 8 are connected to $VO_4$.

(3) If $M_3=1$ (mode $M_3$), $$G_{ij}=TRS_j \cdot S_{ij3}$$

The channels 1, 2, 3 and 4 are connected to $VO_1$. The channels 5, 6, 7 and 8 are connected to $VO_2$. The $VO_1$ can be used for upper manual. The $VO_2$ can be used for lower manual.

(4) If $M_4=1$ (mode $M_4$), $O_{ij}$ represent octave data. Octave ranges are related to the octave data as follows:

$C_2 \sim B_2 \ldots O_{1j}$
$C_3 \sim B_3 \ldots O_{2j}$
$C_4 \sim B_4 \ldots O_{3j}$
$C_5 \sim C_6 \ldots O_{4j}$ where j is a number of the column and a number of the channel. Accordingly, the wave signals of respective octave ranges appear at the $VO_1 \sim VO_4$ as follows:

$C_2 \sim B_2 \ldots VO_1$
$C_3 \sim B_3 \ldots VO_2$
$C_4 \sim B_4 \ldots VO_3$
$C_5 \sim C_6 \ldots VO_4$ In the mode $M_4$, a filtering of sampling noise or a level compensation of the sound signals can be done independently and classified by octave range.

Figure 16:
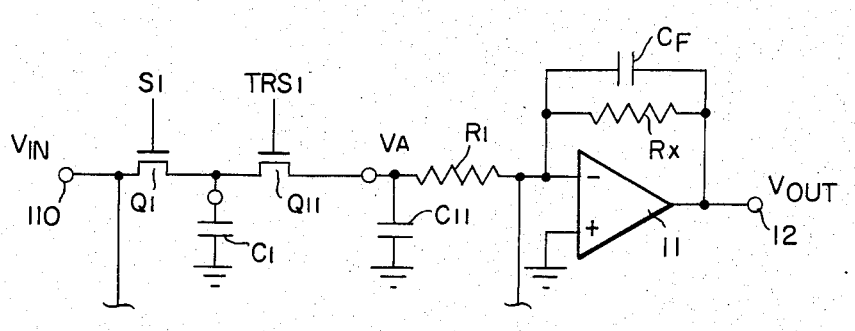
FIG. 16 is a circuit diagram of sill another embodiment of a buffer memory used in the present invention.

FIG. 16 shows another embodiment of the buffer memories 10. Referring to FIG. 16, one channel of the buffer memories 10 is composed of the input terminal 110, the sampling switch Q1, the holding capacitor C1, the read-out switch Q11, a read-out capacitor C11, the input resistor $R_1$ for summing, the operational amplifier 11, the feedback capacitor $C_F$ and the feedback resistor $R_F$. When $R_F$ is large, the amplifier 11 and the capacitor $C_F$ compose an integrator. The time constant $C_{11}.R_1$ is smaller than the period of the read-out signal TRS1. The input voltage $V_{IN}$ is sampled by the sample signal $S_1$ and charges up the capacitor C1. By the reading signal TRS1, the switch Q11 opens and the charge in the capacitor C1 is transferred to the capacitor C11. The transferred charge $q_{11}$ is expressed as follows:

$$q_{11} = \frac{C1 \cdot C_{11}}{C1 + C_{11}} V_{IN}$$

Figure 17:
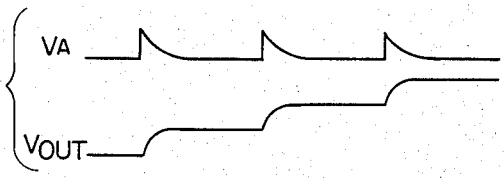
FIG. 17 is a signal wave form chart in the buffer memory shown in FIG. 16.

The charge $q_{11}$ is transferred to the capacitor $C_F$ by the time constant $C_{11}.R_1$. Waveforms of voltages $V_A$ and $V_{out}$ become as shown in FIG. 17. $V_{IN}$ must be a differential voltage.

Figure 18:
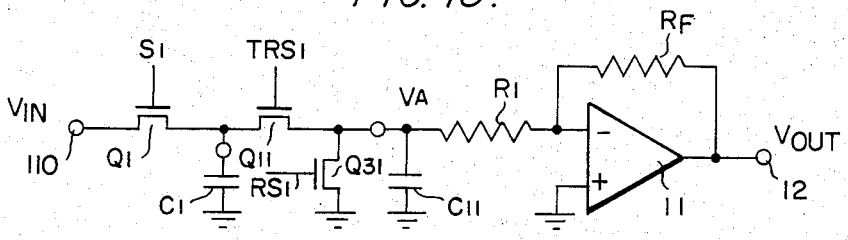
FIG. 18 is a circuit diagram of a further embodiment of a buffer memory used in the present invention.

FIG. 18 shows a further embodiment of the buffer memories 10. Comparing it with FIG. 16, a resetting switch $Q_{31}$ is added. The capacitor $C_F$ is removed. The time constant $C_{11}.R_1$ is larger than the period of the TRS1 signal. Since the voltage $V_A$ at the capacitor $C_{11}$ decreases slowly, the voltage $V_A$ may be regarded as being held. This held charge in the capacitor $C_{11}$ is cleared by the resetting switch $Q_{31}$ before the next reading of the charge on the capacitor $C_1$.

Figure 19:
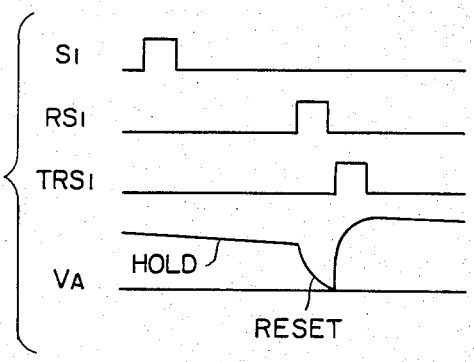
FIG. 19 is a signal wave form chart in the buffer memory shown in FIG. 18.

FIG. 19 shows waveforms of control signals $S_1$, RS1, TRS1 and the voltage $V_A$. $V_A$ and $V_{OUT}$ can be expressed by the following equations:

$$V_A \cong \frac{C1}{C1 + C_{11}} V_{IN}$$

$$V_{out} \cong -\frac{R_F}{R_1} V_A$$

$V_{IN}$ need not be a differential voltage. If C1>>C11, the residual charge on the capacitor C11 is transferred back to the capacitor C1. The resetting switch $Q_{31}$ can be removed. When the time constant $C_{11}.R_1$ is small, the waveform of the voltage $V_A$ becomes as shown in FIG. 17. The resetting switch $Q_{31}$ can be removed. In this case, when the frequency of the TRS1 signal changes, the frequency of the pulse $V_A$ changes. Accordingly, the level of the output signal also changes. To prevent this inconvenience, the amplitude of the $V_{IN}$ should be changed so as to be inversely proportional to the note clock frequency. This is accompished by the wave calculator 7.

When the $V_{IN}$ becomes zero, the $V_{out}$ also becomes zero. In this case, the read out signal TRS1 can be blocked and a muting effect can be obtained.

When the integrator is used as in FIG. 16, a positive input voltage of the operational amplifier must be equal to the average voltage of a negative input voltage of the operational amplifier 11. The positive input voltage can be generated as a reference voltage $V_{REF}$ by the DAC 9 in TDM mode and sample-hold circuit such as the buffer memories 10.

Referring to FIGS. 16 and 18, the charge can be transferred from the holding capacitor C1 to the read-out capacitor C11 in a very short time. Therefore, a large amount of charge can be obtained and a large output signal can be provided as the voltage $V_{OUT}$. The resistor $R_1$ does not affect the transfer of the charge. The resistor $R_1$ also prevents interference with other channels.

Referring to FIG. 1, the gates G1~G8 can be eight latches. Output signals of the eight latches can be provided to the eight DACs through second stage latches. The second latches are controlled by the read-out signals TRS1~TRS8. The eight latches are controlled by the writing signals SMP1~SMP8.

Referring to FIG. 4, the latch 8 can be eight latches. The eight latches are selected by {TS} and the SMP signal and the calculated wave samples are written serially into the eight latches. The eight latches output signals can be provided to second stage latches and eight DACs. The second latches are controlled by the read-out signals TRS1~TRS8. The second latches can output the wave samples of the respective channels in parallel or simultaneously.

In these cases, the first latches and the second latches correspond to the buffer memories.

Referring to FIGS. 1 and 4, the calculation request flags indicate that the calculations of the next sample can be executed. When the calculation request flags are not set at the time slot, the calculations are inhibited. The preceding samples have been calculated and held by the buffer memories. Accordingly, the succeeding samples should not be written in the buffer memories before the preceding samples are read out. Increments of various parameters, such as an address or a counter number, of the calculation should not increase when the CRFs do not occur.

Referring to FIGS. 1 and 4, the occurrence of the calculation request is written in the calculation request register 4 in parallel form. The calculation time slots correspond to the channel numbers, respectively.

Another way of the wave calculation will be described below. When the calculation request occurs, the number of the channel is registered in a FIFO (a first in first out) memory in order of the occurrence. When the plural requests occur at a time, the channel with younger number has a priority to be written in the FIFO. The priority circuit is known as a daisy chain circuit. The wave calculator reads the FIFO memory and catches the channel number. The wave calculator reads the note and octave data corresponding to the channel number. Then, the wave calculator calculates the wave sample data of the note and the octave. The calculated wave sample is written in the corresponding channel of the buffer memory. After that, the wave calculator can read the FIFO memory and executes the next wave calculation. The reading-out of the wave sample in the buffer memories is done at the occurrence of the calculation request.

In this embodiment, the wave calculation is executed as far as the channel number remains in the FIFO memory. When the channel numbers are all read out from the FIFO memory, the calculation will stop. An order of the calculation follows to the occurrence of the calculation request.

The calculated wave samples can be stored in other FIFO memories arranged for the eight channels. At the occurrence of the calculation request, the data stored in the other FIFO memories are read out according to the assigned channel. The calculation of the wave samples in the wave calculator 7 is executed until the other FIFO memories are fully occupied with the wave samples. When the other FIFO memories are full with the wave samples, the wave calculation will stop. When the other FIFO memories are read out and some memories become vacant, the other FIFO request the calculation of the succeeding wave samples for vacant memories in the channel and the wave calculator provides the wave sample to the other FIFO.

In this case, the wave calculation is executed as the other FIFO are almost always full. Therefore, even if the note clock frequency of one channel is very high, the average of the note clock frequencies of eight channels can be lower than the speed of the wave calculation when the note clock frequencies of the remaining channels are low. In this case, there are ample time slots for the wave calculation of a very high note clock frequency.

In these embodiments of the present invention, the FIFO memory corresponds to the controller for controlling calculation and writing. The reading signals can be obtained by the note clock signals. The other FIFO memories can be considered as a part of the buffer memories. The memory managing block of the other FIFO memories can output requests to the wave generator, when the calculation is required.

Referring to FIGS. 1 and 4, the note clock frequency is determined by the note code, as shown in Table 1. The octave lower wave must have doubled samples in one wave period. The higher octave wave must have half samples in one period. The same note clock frequency can be used.

If the note clock frequency is divided by $2^n$ corresponding to the octave, then, the number of samples in one wave period can be same even if the octave data changes.

The twelve note clock frequencies can be reduced to 6 (C, C#, D, D#, E, F). The notes F#, G, G#, A, A# and B can be obtained by reducing the sample number of one wave period by about 29 percent.

While particular embodiments of the invention have been shown and described above, it will be apparant to those skilled in the art that numerous modifications and variations can be made in the form and construction thereof without departing from the scope of the invention.

What is claimed is:

1. A wave reading apparatus comprising:
   - a wave generator for generating a plurality of wave samples one of which representing a different note from that of the remainder of said samples;
   - a read-out frequency generator for generating a plurality of read-out frequencies at the same time;
   - a controller for controlling calculation and writing, said controller informing requests of wave samples to said wave generator in accordance with said read-out frequencies;
   - a plurality of buffer memories for storing said wave samples, one of said buffer memories storing wave samples of a different note from that of the remainder of said samples;
   - a writing device for writing said wave samples into said plurality of buffer memories; and
   - a plurality of read-out devices for reading out said wave samples from said buffer memories in response to said plurality read-out frequencies.

2. A wave reading apparatus as claimed in claim 1, wherein said writing device provides said wave signals to said buffer memories serially.

3. A wave reading apparatus as claimed in claim 1, wherein said reading device parallelly reads out said wave signals stored in said buffer memories.

4. A wave reading apparatus as claimed in claim 1, wherein said wave generator operates in time division multiplexed mode and generates wave samples in a predetermined calculation time slot.

5. A wave reading apparatus as claimed in claim 1, wherein said controller has a plurality of calculation request flag registors which are set by the requests of wave samples in response to said read-out frequencies, inform occurrence of said requests of wave samples generation to said wave generator, and are reset by writing of said wave samples into said buffer memories.

6. A wave reading apparatus as claimed in claim 1, wherein said wave samples generated by said wave generator are written in said buffer memories as analog signals and said read-out devices read out said analog signals.

7. A wave reading apparatus as claimed in claim 1, wherein said wave generator generates said wave samples as differential form of data and said wave samples read out from said read-out devices are accumulated by an integrating circuit.

8. A wave reading apparatus as claimed in claim 1, wherein: said wave generator has a wave signal generator and an envelope generator; said writing device has a digital-to-analog converter and a multiplying digital-to-analog converter, one of output signals of said wave signal generator and said envelope generator being applied to said digital-to-analog converter and the other of said output signals to said multiplying digital-to-analog converter, an output signal of said digital-to-analog converter being applied to said multiplying digital-to-analog converter and multiplied with said the other of said output signals, and an output signal of said multiplying digital-to-analog converter being stored in said buffer memories.

9. A wave reading apparatus as claimed in claim 1, wherein said writing deive is a digital-to-analog converter for sequentially providing said wave samples from said wave generator to said buffer memories in an analog signal form.

* * * * *

Notice of Adverse Decisions in Interference

In Inteference No. 101,610, involving Patent No. 4,528,884, K. Kawamoto, and K. Murase, WAVE READING APPARATUS, final judgment adverse to the patentees was rendered July 19, 1989, as to claims 1-4.

*(Official Gazette February 20, 1990)*